US007814918B2

(12) United States Patent
Nagai et al.

(10) Patent No.: US 7,814,918 B2
(45) Date of Patent: Oct. 19, 2010

(54) APPARATUS FOR CLEANING INKJET HEAD AND CLEANING METHOD THEREOF

(75) Inventors: Souichi Nagai, Yokohama (JP); Mikio Sanada, Yokohama (JP); Nobuyuki Matsumoto, Tokyo (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 11/769,293

(22) Filed: Jun. 27, 2007

(65) Prior Publication Data

US 2008/0283092 A1 Nov. 20, 2008

Related U.S. Application Data

(63) Continuation of application No. PCT/JP2005/023851, filed on Dec. 27, 2005.

(30) Foreign Application Priority Data

Dec. 28, 2004 (JP) ..... 2004-381749
Aug. 15, 2005 (JP) ..... 2005-235406

(51) Int. Cl.
*B08B 3/00* (2006.01)

(52) U.S. Cl. ..... 134/184; 134/182; 347/33; 347/45

(58) Field of Classification Search ..... None
See application file for complete search history.

(56) References Cited

U.S. PATENT DOCUMENTS 5,266,974 A 11/1993 Koitabashi et al.
5,905,514 A 5/1999 Rhoads et al.
5,969,731 A 10/1999 Michael et al.
5,997,128 A 12/1999 Lou et al.
6,017,110 A 1/2000 Jackson (Continued)

FOREIGN PATENT DOCUMENTS

EP 0 856 404 8/1998

(Continued)

OTHER PUBLICATIONS

Chinese Office Action dated Feb. 6, 2009.

(Continued)

*Primary Examiner*—Michael Komakov
*Assistant Examiner*—Eric Golightly
(74) *Attorney, Agent, or Firm*—Fitzpatrick, Cella, Harper & Scinto

(57) ABSTRACT

In a method of cleaning an ejection face by supplying a head liquid on a surface (ejection face) of an inkjet head provided with ink ejection outlets, and then by performing wiping operations thereon, an ink residue on the ejection face is efficiently and surely removed from the ejection face to achieve a sufficient cleaning thereon. For this purpose, a first wiping operation is first performed such that a wiper (9A) is relatively largely bent, and slidingly contacts the ejection face at an abdomen thereof to efficiently perform the application, stirring and mixing of the head liquid. Then, a second wiping operation is performed such that an edge portion of the top end of a wiper (9B) slidingly contacts the surface to efficiently scrape the mixture of the head liquid and the ink residue.

5 Claims, 11 Drawing Sheets

U.S. PATENT DOCUMENTS

| | | | | |
|---|---|---|---|---|
| 6,145,953 | A | 11/2000 | Medin | |
| 6,224,186 | B1 | 5/2001 | Johnson et al. | |
| 6,520,621 | B1 | 2/2003 | Eckard et al. | |
| 6,530,642 | B1 | 3/2003 | Uchikata et al. | 347/33 |
| 6,669,327 | B1 | 12/2003 | Harper | |
| 2007/0247484 | A1 | 10/2007 | Sanada et al. | |
| 2008/0136857 | A1 | 6/2008 | Ogasawara et al. | |

FOREIGN PATENT DOCUMENTS

| | | |
|---|---|---|
| EP | 1 010 535 | 6/2000 |
| GB | 2 358 613 | 8/2001 |
| JP | 59-083664 | 5/1984 |
| JP | 06-000964 | 1/1994 |
| JP | 10-138502 | 5/1998 |
| JP | 10-138503 | 5/1998 |
| JP | 10-151759 | 6/1998 |
| JP | 11-254692 | 9/1999 |
| JP | 11-286116 | 10/1999 |
| JP | 2000-203037 | 7/2000 |
| JP | 2001-260371 | 9/2001 |
| JP | 2004-338223 | 12/2004 |

OTHER PUBLICATIONS

Communication—Appln. No. 05 822 432.0-1251, European Patent Office, Feb. 4, 2010.

APPARATUS FOR CLEANING INKJET HEAD AND CLEANING METHOD THEREOF

This application is a continuation application of PCT application No. PCT/JP2005/023851 under 37 Code of Federal Regulations §1.53(b) and the said PCT application claims the benefit of Japanese Patent Application Nos. 2004-381749, filed Dec. 28, 2004 and 2005-235406, filed Aug. 15, 2005, which are hereby incorporated by reference herein in their entirety.

BACKGROUND OF THE INVENTION

1. Field of the Invention

The present invention relates to an inkjet recording apparatus and a method of cleaning an inkjet head which is used in the apparatus. The present invention specifically relates to a technology for cleaning the inkjet head (hereinafter also referred to as a recording head or simply a head) by efficiently removing an ink residue and the like adhered on the surface (hereinafter also referred to as an ejection face) of the inkjet head, on which ink ejection outlets are formed.

2. Description of the Related Art

A clean-up (cleaning) technique for a recording head which ejects an ink is a very important factor of an inkjet recording method because the method is the system in which input image data is converted to the output image using a liquid ink as a medium. Main problems in requiring the cleaning are briefly described as follows.

An ink ejection recording head directly ejects an ink through a fine nozzle (hereinafter, as such collectively referred to as an ejection opening, a liquid passage communicated therewith, and an element for generating energy utilized to eject ink unless otherwise stated) to a recording medium. Accordingly, the ejected ink hits against the recording medium and bounces back, and, in addition to the main ink involved in the recording when the ink is ejected, fine ink droplets (satellites) are ejected and drift in the atmosphere in some cases. Then, these droplets become ink mists, and, in some cases, adhere around the ink ejection opening of the recording head. Furthermore, dust drifting in the air may sometimes adhere thereto. Subsequently, the ejected main ink droplets are pulled by these attached matters, thereby the ink ejection direction is deflected, i.e., the main ink droplets are blocked from going straight in some cases.

Then, as a cleaning technique for solving this problem, an instrument called a wiping is employed to remove attached matters in the inkjet recording apparatus. The instrument wipes, at a predetermined timing, the ejection face of the recording head by means of a wiping member (wiper) made of an elastic material such as rubber.

Meanwhile, for the purpose of improving the recording density, water-resistance, light-resistance and the like of a recorded matter, an ink containing pigment components as a color material (pigment-based ink) has recently been used in many cases. The pigment-based ink is made by dispersing, in water, the color material which is originally solid by introducing a dispersant or a functional group on the surface of the pigment. Accordingly, the dried matter of the pigment ink formed by evaporating and drying the water content in the ink on the ejection face damages the ejection face seriously as compared to the dried sticky matter of a dye-based ink in which a color material itself is dissolved at a molecular level. A characteristic is also recognized that a high molecular compound used to disperse the pigment in a solvent tends to be adsorbed on the ejection face. This is a problem which occurs even in inks other than the pigment-based one in a case where a reaction liquid is added to an ink for the purpose of controlling the viscosity of the ink, improving light-resistance and for others, resulting in the presence of a high molecular compound in the ink.

To solve these problems, in Patent Documents 1 and 2, disclosed are techniques for removing an accumulated matter by applying a head liquid of nonvolatile solvent on the ejection face to reduce the wear of a wiper and dissolve the ink residue accumulated on the recording head in wiping the recording head. Moreover, the adhesion of a foreign matter to the recording head is prevented by forming a thin film of the head liquid on the recording head, and wiping easiness is improved by these. A construction in which the head liquid used in these wiping is stored in the body of a printer is employed.

In Patent Document 3, it is disclosed that wiping operations are performed on the ejection face of the head after a head liquid composed of nonvolatile solvent is applied on a wiper.

In addition, in Patent Document 4, it is disclosed that a dissolved liquid is sprayed on the ejection face, and thereby insolubilized matters adhered on the ejection face are removed using a wiper.

Furthermore, in Patent Document 5, it is disclosed that wiping operations are performed by dissolving ink residues on a head in a nonvolatile ink solvent held on a wiper.

In the methods described in the above documents, wiping conditions including the state of sliding contact of the wiper with the ejection face are not specified. In Patent Documents 1 to 3 and 5, if all the wiping operations are performed by causing the top end portion (edge) of the wiper to slidingly contact the ejection face, the application of the head liquid is performed by means of the edge. In this case, the mixing of the head liquid and the ink residue cannot be favorably performed, and the wiping off the ejection face becomes incomplete. As a result, the desired cleaning may not be able to be achieved. Moreover, when the wiping operations are performed in a state where the head liquid is not adequately applied, the ejection face may be deteriorated. Furthermore, in the configuration disclosed in Patent Document 4, the head liquid is adhered to the surface only, and the head liquid and the ink residue may not sufficiently be mixed. As a result, the desired cleaning may not be achieved.

Patent Document 1: Japanese Patent Laid-Open No. 10-138503

Patent Document 2: Japanese Patent Laid-Open No. 2000-203037

Patent Document 3: Japanese Patent Laid-Open No. 10-138502

Patent Document 4: Japanese Patent Laid-Open No. 10-151759

Patent Document 5: Japanese Patent Laid-Open No. 11-254692

SUMMARY OF THE INVENTION

Therefore, an object of the present invention is to efficiently and surely remove the ink residue from the ejection face, and thereby the original performance that the recording head has is maintained.

Therefore, a device for cleaning an inkjet head according to the present invention is characterized by comprising means, while applying a head liquid on a surface of the inkjet head provided with ejection outlets through which an ink containing a color material is ejected, for stirring and mixing with an ink residue on the surface, and thereafter for scraping the mixture from the surface.

Further, the present invention exists on a inkjet recording apparatus comprising the above cleaning device.

Moreover, a method of cleaning an inkjet head according to the present invention is characterized by comprising: a first step, while applying a head liquid on a surface of the inkjet head provided with ejection outlets through which an ink containing a color material is ejected, of stirring and mixing an ink residue on the surface; and a second step of scraping the mixture from the surface.

According to the present invention, the ink residue is incorporated in the head liquid by applying, stirring and mixing the head liquid with the ink residue. For example, by performing the wiping operation such that the wiper is relatively largely bent to cause the abdomen thereof to slidingly contact the head surface (ejection face), the application, stirring and mixing of the head liquid are efficiently performed. Then, by performing the wiping operation such that the edge portion of the top end of the wiper slidingly contacts the surface, the mixture of the head liquid and the ink residue can efficiently be scraped. By carrying out the above steps, the ink residue can efficiently be removed from the ejection face, and thereby the surface properties of the ejection face are inhibited from changing to maintain the original properties which the recording head has. As a result, a stable image quality can be maintained.

In addition, suppose that the relationships of the surface tension of the ejection face<the surface tension of the ink<the surface tension of the head liquid is established. In such a condition, if the ink residue having a low surface tension compared to the head liquid is dissolved in the head liquid having the higher surface tension, the ink residue is in a state of the enhanced surface tension. Accordingly, the wetting with respect to the ejection face is more reduced. As the result of this, the mixture is smoothly moved by the second wiping operation.

Further features of the present invention will become apparent from the following description of exemplary embodiments (with reference to the attached drawings).

DESCRIPTION OF THE EMBODIMENTS

With reference to the drawings, the present invention will hereinafter be described in detail.

(Embodiment of Apparatus)

Figure 1:
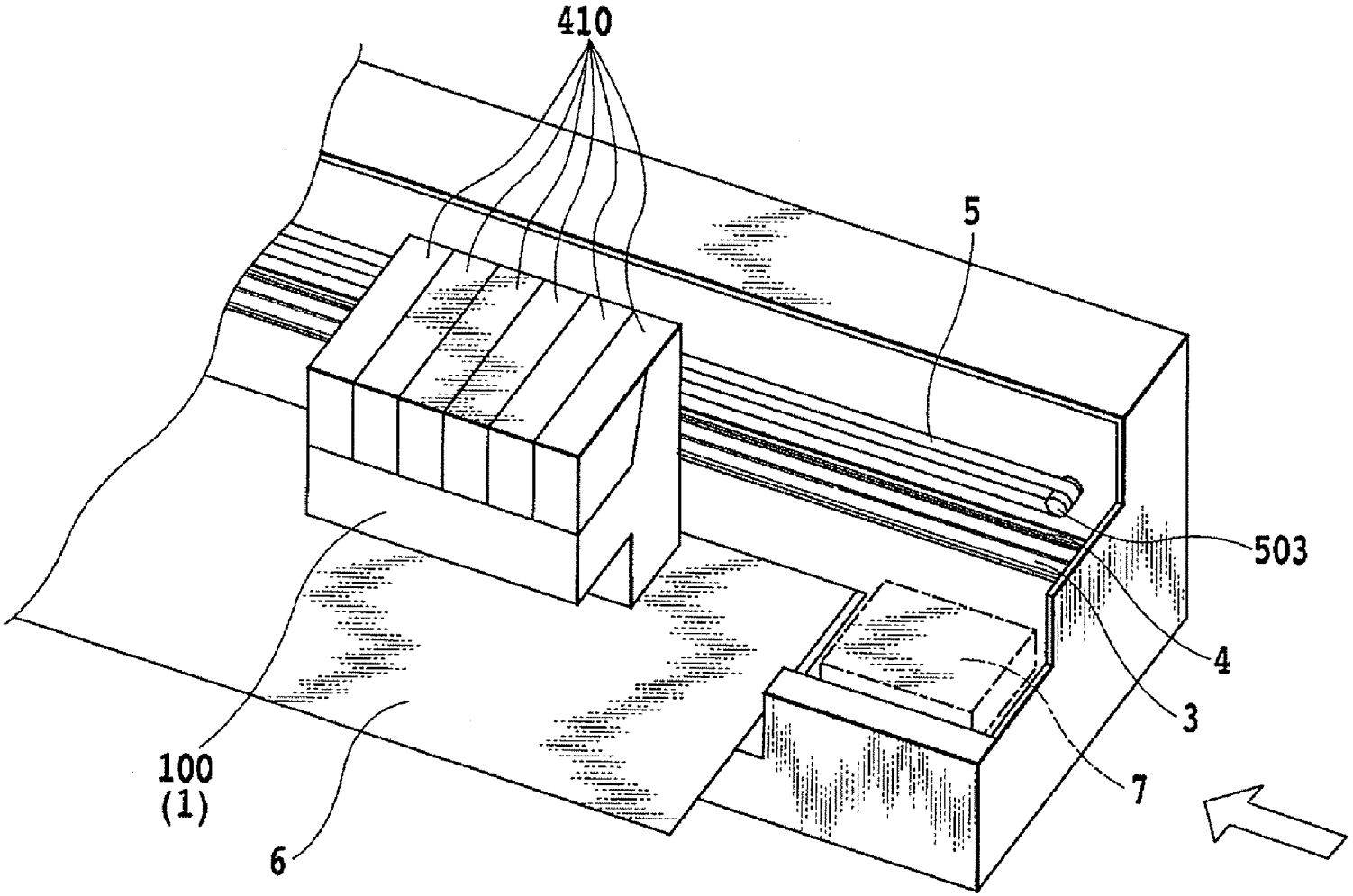
FIG. 1 is a diagrammatical perspective view of the main portion of an inkjet printer related to one embodiment of the present invention.

FIG. 1 is a diagrammatical perspective view of the main section of an inkjet printer related to an embodiment of the present invention.

In the illustrated inkjet recording apparatus, a carriage 100 is fixed to an endless belt 5, and is movable along a guide shaft 3. The endless belt 5 is wound on a pair of pulleys 503. The driving axis of a carriage driving motor (not illustrated) is connected to one of the pair of pulleys 503. Accordingly, the carriage 100 is caused to mainly scan along the guide shaft 3 reciprocally in the right and left directions in the drawing as the motor is rotatably driven. A cartridge-type recording head 1 which attachably and removably holds an ink tank 410 is mounted on the carriage 100.

Figure 2:
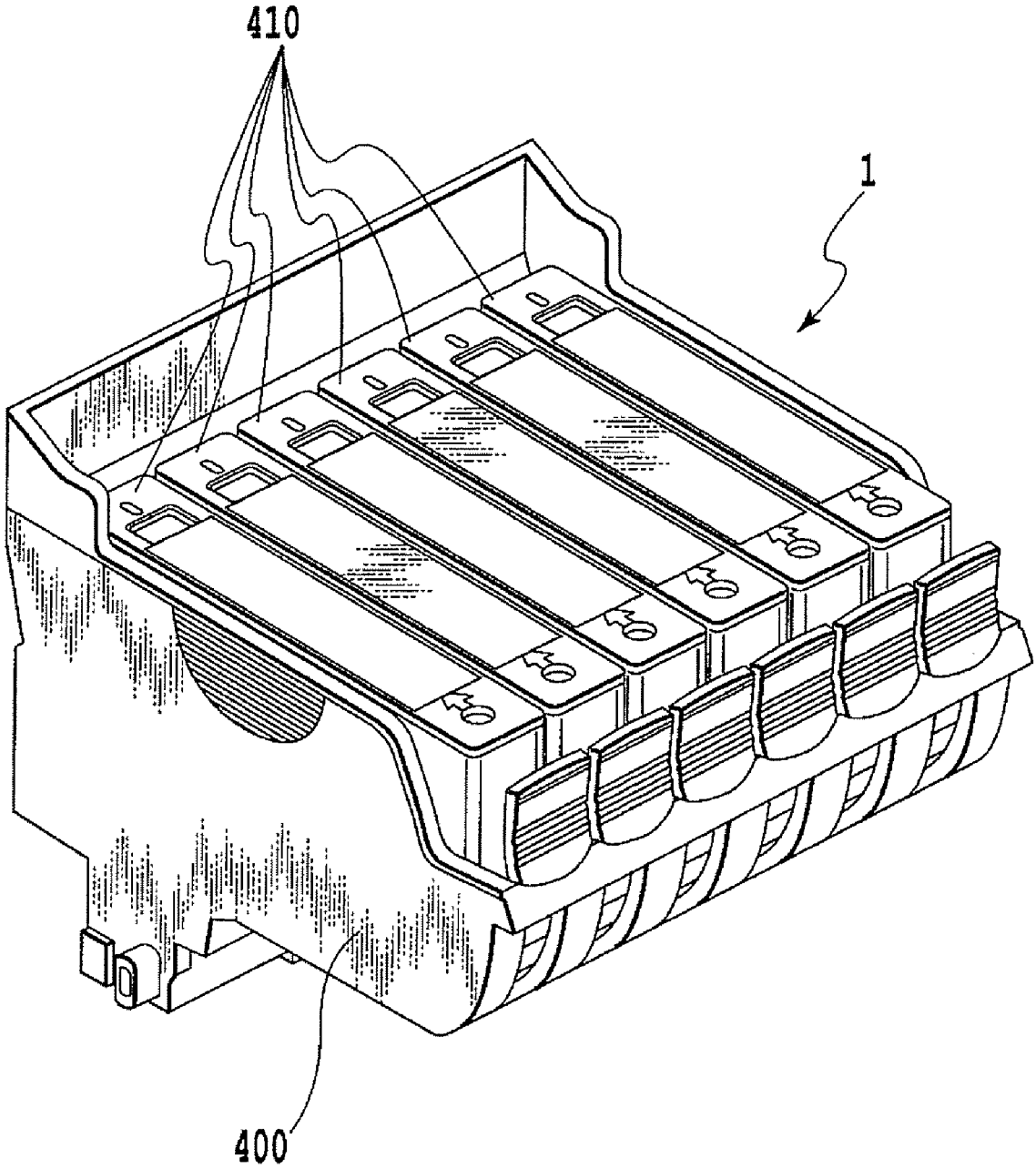
FIG. 2 is a perspective view showing one configuration example of a recording head which can be mounted to a carriage of the inkjet printer of the FIG. 1.
Figure 3:
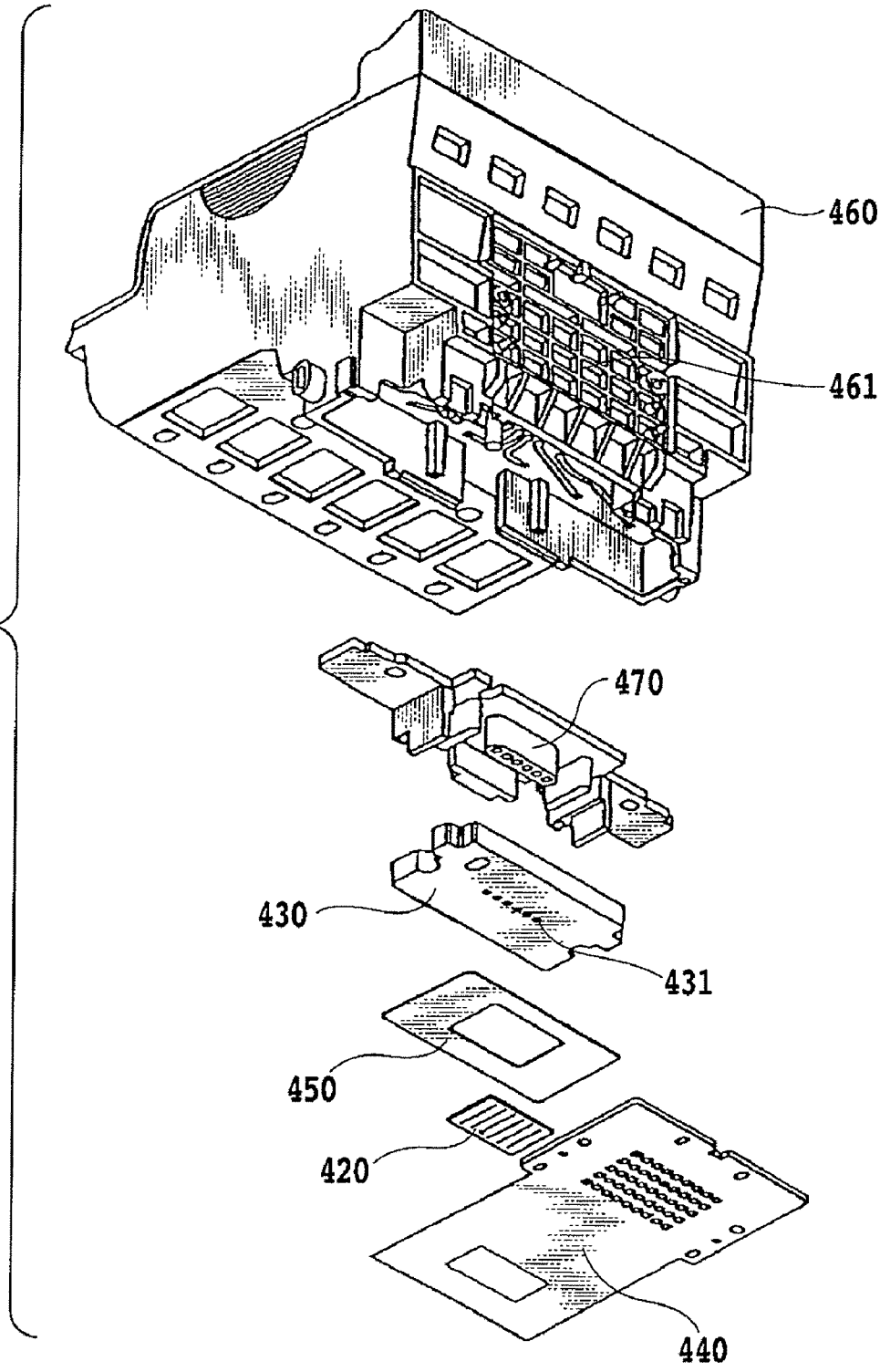
FIG. 3 is an exploded perspective view showing one configuration example of the recording head unit which is a component of the recording head unit of FIG. 2.

FIG. 2 is a perspective view showing one configuration example of the recording head 1 which can be mounted on the carriage 100 of FIG. 1. FIG. 3 is an exploded perspective view showing one configuration example of a head unit which is the component of the recording head 1.

The recording head 1 related to the present example includes a head unit 400 having arrays of ejection openings through which an ink is ejected, and ink tanks 410 each of which stores an ink and supplies the ink to the head unit 400. The recording head 1 is mounted on the carriage 100, so that ink ejection opening arrays provided to the head unit 400 faces to a paper sheet 6 which is a recording medium, and that the above array direction accords with a different direction (for example, sub-scanning direction which is the transporting direction of the recording medium 6) from a main scanning direction. A set of the array of ink ejection openings and the ink tanks 410 can be provided with the number corresponding to the number of the ink colors to be used. In the illustrated example, six sets are provided corresponding to six colors (for example, black (Bk), cyan (C), magenta (M), yellow (Y), pale cyan (PC) and pale magenta (PM)). In the recording head 1 shown here, the independent ink tanks 410 for each color are prepared, and each is attachable to and removable from the head unit 400.

As shown in FIG. 3, the head unit 400 is configured of a recording element substrate 420, a first plate 430, an electric wiring board 440, a second plate 450, a tank holder 460 and a flow path formation member 470. The recording element substrate 420 having ejection opening arrays for respective color inks is adhesively fixed on the first plate 430 made of aluminum oxide ($Al_2O_3$) as a material. In the first plate 430, ink supply ports 431 are formed for supplying ink to the recording element substrate 420. The second plate 450 having an opening is furthermore adhesively fixed to the first plate 430. The second plate 450 holds the electric wiring board 440 so that the electric wiring board 440 which applies electric signals for ejecting an ink is electrically connected with the recording element substrate 420. On the other hand, the flow path formation member 470 is ultrasonically welded to the tank holder 460 attachably and removably holding the ink tank 410, and thereby an ink flow path (not illustrated) is formed across the ink tank 410 through the first plate 430.

Figure 4:
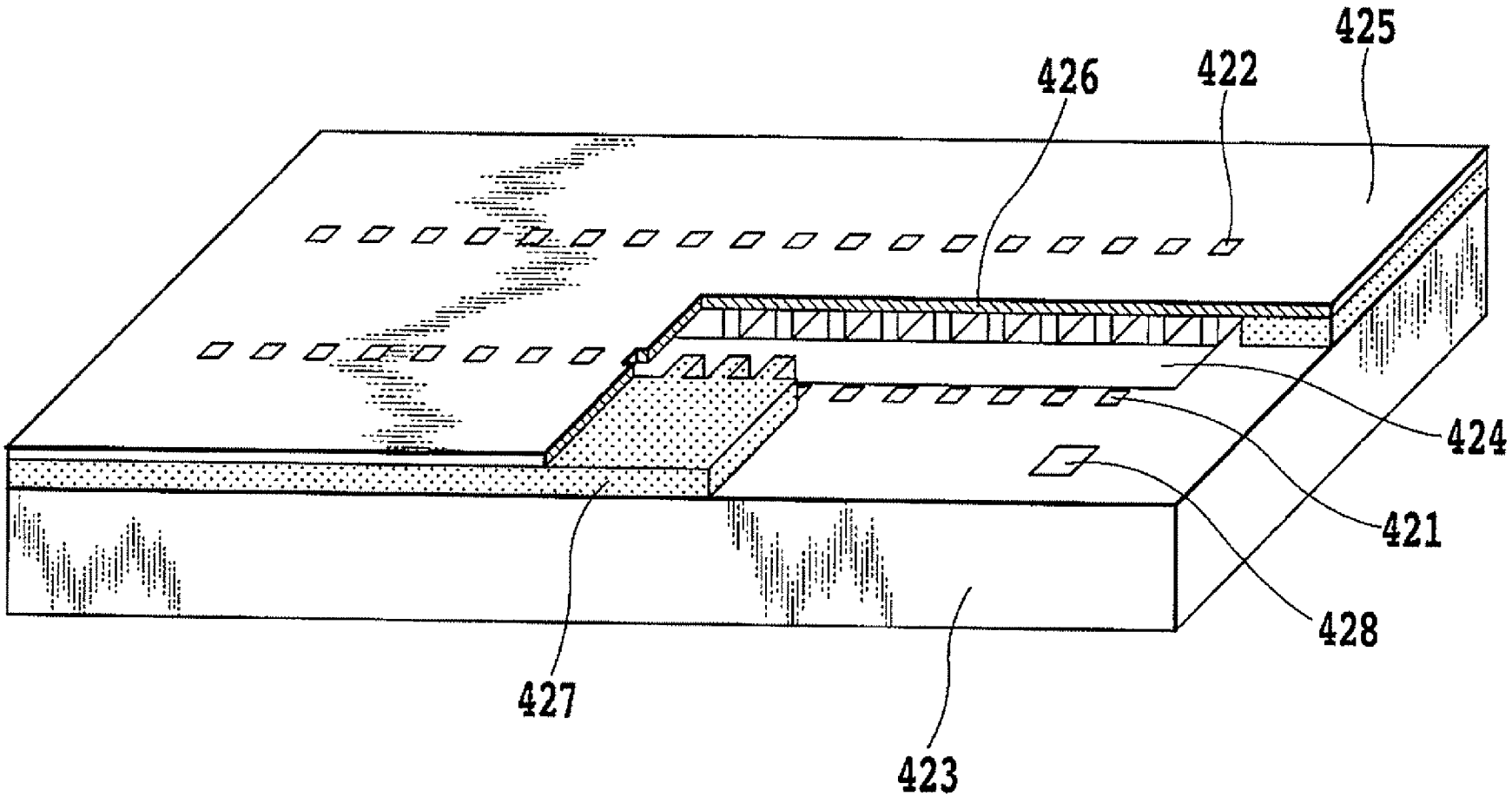
FIG. 4 is a partially ruptured perspective view showing a construction around ejection opening array for a single color on a recording element substrate used in the recording head of FIG. 3.

FIG. 4 is a partially ruptured perspective view showing the structure around the ejection opening array for a single color in the recording element substrate 420 shown in FIG. 3. In FIG. 4, a numeral 421 indicates a heat generation element (heater) which generates thermal energy which causes film boiling in an ink in accordance with the application of an electric current as energy utilized to eject an ink. A temperature sensor 428 for sensing the temperature of the head unit 400, and a sub-heater (not illustrated) for keeping the head or the ink warm in accordance with the detected temperature are provided on a base body 423 on which the heater 421 is mounted. A numeral 422 indicates an ink ejection opening, and a numeral 426 indicates an ink flow path wall. A numeral 425 indicates an ejection opening plate in which the ink ejection openings 422 are formed with a state facing to each heater. This plate is disposed on the base body 423 with a resin coated layer 427 interposed therebetween. Moreover, a desired water-repellent material is provided on the surface (ejection face facing to the recording medium) of the ejection opening plate 425.

In the present example, two lines of the heaters 421 or the ejection openings 422 are disposed, and the heaters 421 or the ejection openings 422 within each line are disposed so as to shift with each other by a half of array pitch in an array direction, i.e. sub-scanning direction. In this respect, by arraying 128 pieces of heaters 421 or ejection openings 422 per one line in a density of 600 dpi, a resolution of 1200 dpi is realized per one color of ink. Then, the configuration of the recording element substrate corresponding to the above six colors is disposed on the first plate 430.

A method of making a recording element substrate and an ejection face will be described by using FIGS. 5A to 5G.

Figure 5A:
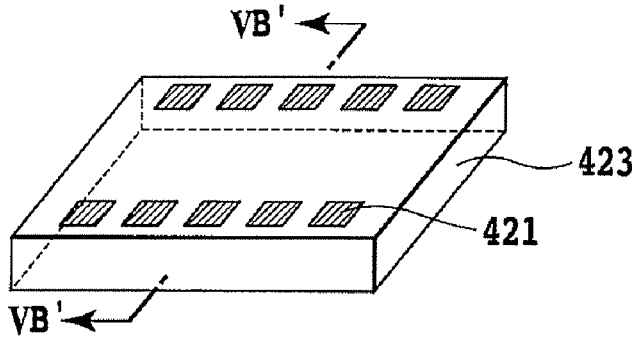
FIG. 5A is an explanatory drawing of a production step of the recording element substrate of FIG. 4.
Figure 5B:
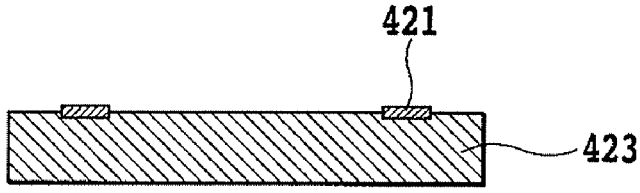
FIG. 5B is an explanatory drawing of the production step of the recording element substrate of FIG. 4.

FIGS. 5A and 5B are a diagrammatic perspective view of the recording element substrate 420 and a diagrammatic cross-sectional view thereof taken along the line VB'-VB', respectively. A plurality of heaters 421 is disposed on the base body 423 made of silicon and the like (an electrode and the like for applying a current to a heater are not illustrated).

Figure 5C:
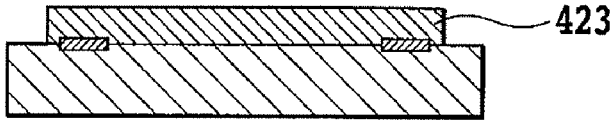
FIG. 5C is an explanatory drawing of the production step of the recording element substrate of FIG. 4.

FIG. 5C is a drawing in which an ink flow path pattern formation material 433 is disposed on the base body 423 shown in FIG. 5B using a positive type resist. The ink flow path pattern formation material 433 corresponds to a pattern for configuring a common liquid chamber for temporarily holding the ink which is supplied to each ejection opening, and ink flow paths which are branched in plural from the common liquid chamber to cause film boiling by the heater.

Figure 5D:
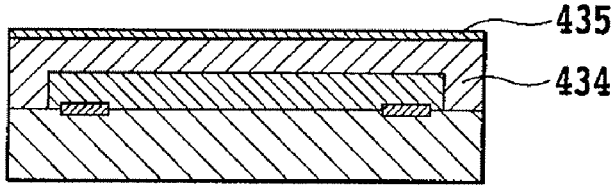
FIG. 5D is an explanatory drawing of the production process of the recording element substrate of FIG. 4.

FIG. 5D is a drawing showing the state where a nozzle formation material 434 made of a negative type resist and a water-repellent material 435 which is a negative type resist containing fluorine and siloxane molecules are formed on the ink flow path pattern formation material 433 shown in FIG. 5C. In the present embodiment, the ejection opening plate 425 is formed of these materials. The water-repellent property can be provided to the ejection face by using the water-repellent material 435 in the above manner. Alternatively, the ejection face can be changed to have desired surface properties in this step by changing a material which is to be combined with the nozzle formation material. Moreover, in a case where the water-repellent property is not necessary for the ejection face, the ejection face which does not have water-repellent property can be formed by not using a water-repellent material but using a nozzle material only.

Figure 5E:
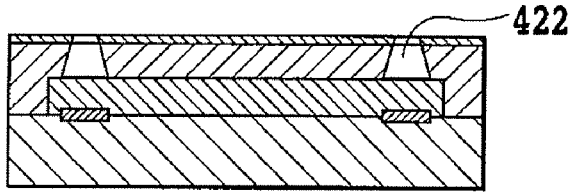
FIG. 5E is an explanatory drawing of the production step of the recording element substrate of FIG. 4.
Figure 5F:
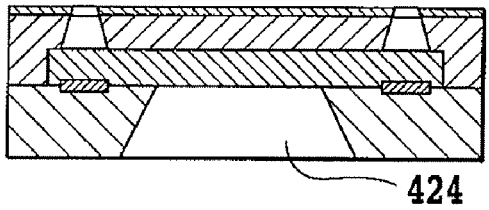
FIG. 5F is an explanatory drawing of the production step of the recording element substrate of FIG. 4.
Figure 5G:
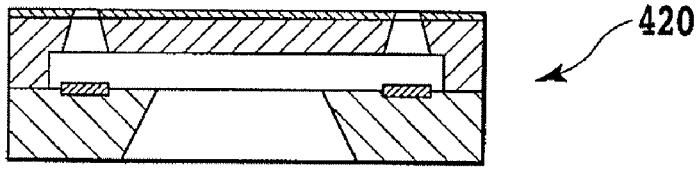
FIG. 5G is an explanatory drawing of the production step of the recording element substrate of FIG. 4.

FIG. 5E is a drawing showing the state where the ink ejection opening 422 and an ink path communicated therewith are formed by using a photolithography method, from the state of the FIG. 5D. Furthermore, FIG. 5F is a drawing showing the state where an ink supply port 424 is formed by anisotropically etching silicon from the back surface side of the base body 423 while the ejection opening formation surface side and the like are appropriately protected, from the state of the FIG. 5E. FIG. 5G shows the state where a recording element substrate is completed by eluting the ink flow path formation pattern material 433 from the state of FIG. 5F. The recording element substrate 420 thus completed is disposed on the first plate 430. Furthermore, the connection with and the electrical mounting on each section, for example, are performed, and thereby the configuration shown in FIG. 2 is obtained.

Referring once more to FIG. 1, the recording medium 6 is intermittently transported in the direction perpendicular to the scanning direction of the carriage 100. The recording medium 6 is supported by a pair of roller units (not illustrated) provided on the upstream side and the downstream side of the transport direction, respectively, imparted with a certain amount of tension, and then transported while maintaining flatness relative to the ink ejection opening. Recording across a width corresponding to the array width of the ejection openings of the head unit 1 in association with the movement of the carriage 100 and the transportation of the recording medium 6 are then alternately repeated, and thereby recording is performed on the entire recording medium 6. The illustrated apparatus is provided with a linear encoder 4 for the purpose of detecting the movement position of the carriage in the main scanning direction.

Figure 6:
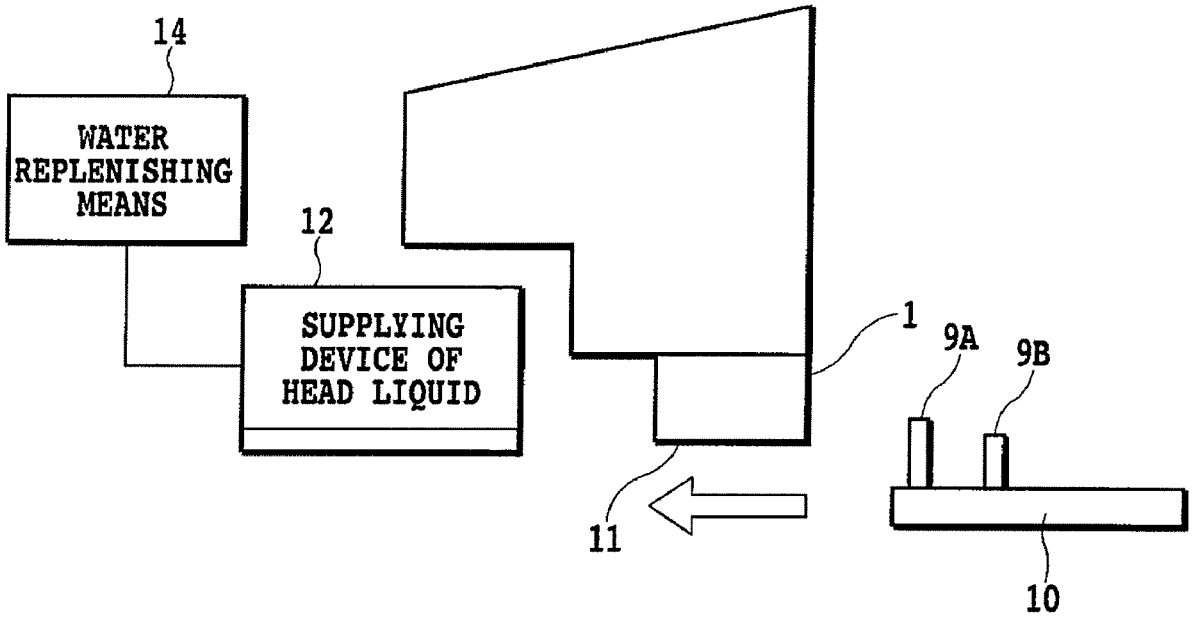
FIG. 6 is a diagrammatical side view showing one example of a cleaning device used in the printer of FIG. 1.

The carriage 100 stops at the home position as necessary at the time of starting recording or during recording. A cap and a maintenance mechanism 7 including a cleaning device described below in FIG. 6 are provided near the home position. The cap is supported in a manner capable of being ascended and descended. In an ascended position, the cap can cap the ejection face of the head unit 1, and thereby it is possible to protect the face at the non-recording operation time or to perform a suction recovery. At a recording operation time, the cap is set in a descended position to avoid the interference with the head unit 1, or it is possible to receive preliminary ejection by facing to the ejection face.

FIG. 6 is a diagrammatic side view showing an example of the cleaning device related to the present invention, and viewed from the direction indicated by the arrow of FIG. 1.

Wiper blades 9A and 9B made of an elastic member such as rubber and the like are fixed to a wiper holder 10. The wiper holder 10 is movable in the right and left directions (the direction which is perpendicular to the main scanning direction of the recording head 1, and in which the ink ejection openings are arrayed) shown in the drawing. The wiper blade 9A and 9B are different in height from each other. As a result, when slidingly contacting the ejection face 11 of the recording head 1, the former bends to a relatively large extent, thus causing the side section thereof to touch the ejection face 11, and the latter bends to a relatively small extent, thus cause the top end section to touch the ejection face 11.

A numeral 12 indicates a supplying device for transferring the head liquid by bringing the wiper blades into contact therewith, and can be in a form in which the head liquid is accommodated in a tank (container). Moreover, the supplying device can have an absorption body in at least a contact portion therewith, the absorption body holding a predetermined amount of the head liquid, while causing the head liquid to bleed out in accordance with the contact with the wiper blades. Furthermore, a stirring device or the like may be added thereto in order to obtain the uniformly mixed state of the head liquid. A numeral 14 indicates a water replenishing device which serves as a device for maintaining the performance of the head liquid. This equipment is disposed so that the head liquid maintains the range of the surface tension specified by the above equations (1) and (2) even when moisture evaporation occurs due to an extreme change in an environment in a case of using the head liquid containing water. This replenishing device is not necessary to operate as long as the head liquid maintains the state specified in the present invention. However, the surface tension can suitably be changed or maintained within the range which the present invention discloses in some desired conditions. Naturally, a case may be assumed where the head liquid loses the water content because an unexpected event occurs under normal circumstances such as the case where the head liquid is placed in an abnormal environment, or left in an inappropriate condition, and thereby the above specifications are not satisfied. In such a case, the head liquid is preferably used by replenishing with this means 14 to keep in the conditions within the range of the present invention.

In a cleaning operation, the head liquid first is transferred by bringing the wiper blades into contact with the supplying device 12 before the recording head 1 is caused to stand by in a position apart from the home position, or before the recording head 1 is moved to the home position. Then, the wiper holder 10 is returned to the position shown in the drawing, and the recording head is set in the home position, and thereafter the wiper holder 10 is once more moved in the direction indicated by the arrow. In this moving process, to begin with, the relatively long wiper blade 9A first slidingly contacts the ejection face 11, and the relatively short wiper blade 9B follows this.

Figure 7:
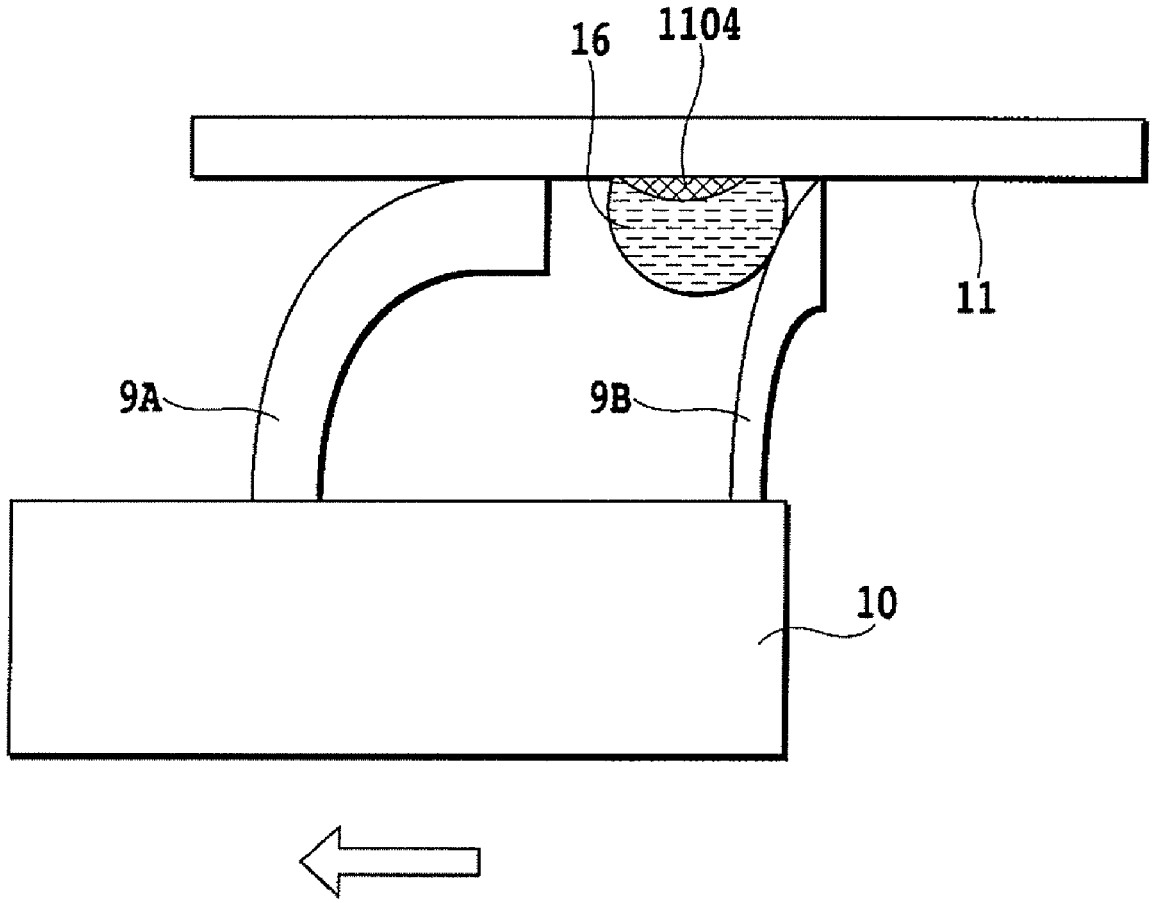
FIG. 7 is a diagrammatical drawing for explaining the operation of the cleaning device of FIG. 2.

FIG. 7 is an explanatory drawing of this process. The wiper blade 9A bends to a relatively large extent, and thus the side section (abdominal part) thereof slidingly contacts the ejection face 11 to efficiently transfer and apply the head liquid 16 to the ejection face 11. Even if there is an ink residue 1104 on the ejection face 11, the ink residue 1104 is dissolved by applying the head liquid 16. The top end section (edge) of the wiper blade 9B touches the ejection face 11 in this state so as to efficiently scrape off the dissolved matter of the ink residue. Thus, the cleaning of the recording head is performed.

Note that, as a result of the wiping, the dissolved matter of the ink residue is attached on the wiper blade 9B. When this flows down along the wiper blade by the action of gravity, a member which receives this at the position below the illustrated wiper holder 10 can be provided.

However, it is desirable to provide means (a sponge, scraper, or the like) which touches the wiper blades 9A and 9B near the supplying device 12 to actively receive the dissolved matter from the wiper blades, or the above process, and thereby to clean the wiper blades. If the head liquid is transferred after the wiper blades 9A and 9B are made into a cleaned state, it is possible to prepare for the next wiping operation immediately.

In performing the above cleaning, a configuration for maintaining the performance of the head liquid is preferably employed. The wiper blade 9A should obtain the desired transferred amount (transferred amount from the supplying device 12 to the wiper blade 9A and transferred amount from the wiper blade 9A to the ejection face 11) in association with the sliding abutment with the supplying device 12 and the ejection face 11. For this purpose, the material, shape, dimension, and position relative to the slidingly contacted target should be determined. On the other hand, this is because, if the changes in weight and in physical properties of the head liquid caused by changes in environment are large, the desired transferred amount may not be obtained, and thereby the cleaning performance thereof may be reduced.

(Detailed Description of Cleaning Operation and Suitable Conditions)

Figure 8A:
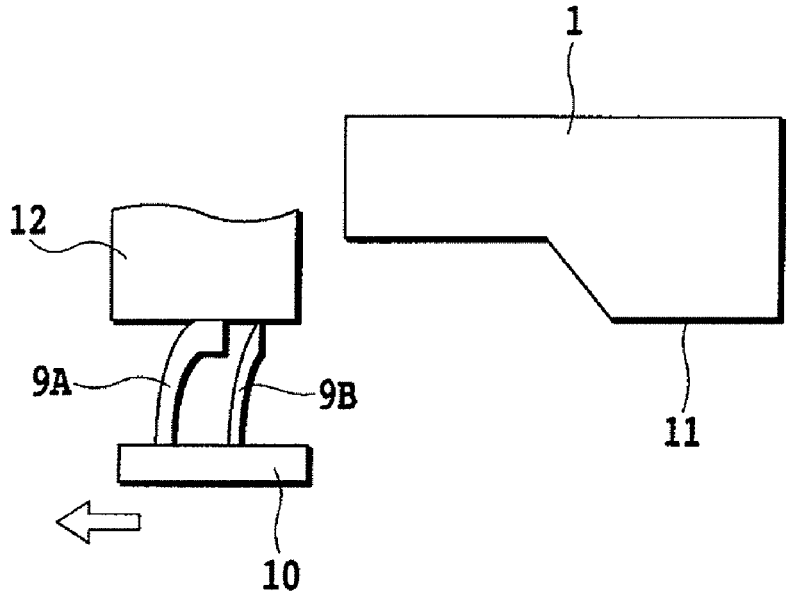
FIG. 8A is an explanatory drawing diagrammatically showing the movement of a wiper blade in the cleaning operation.
Figure 8B:
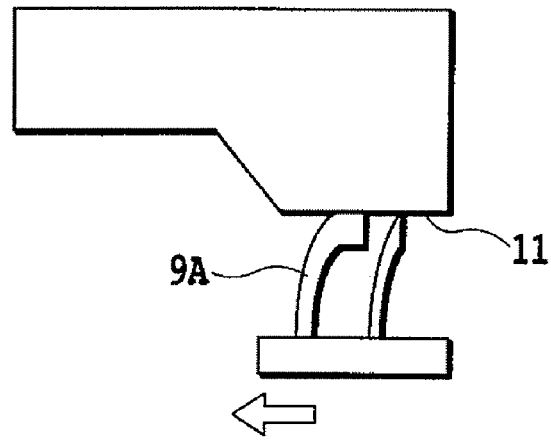
FIG. 8B is an explanatory drawing diagrammatically showing the movement of the wiper blade in the cleaning operation.
Figure 8C:
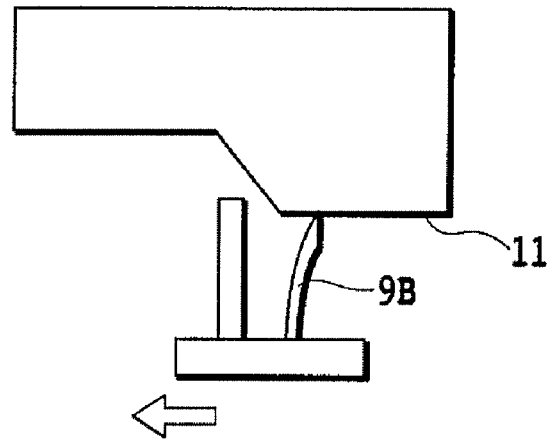
FIG. 8C is an explanatory drawing diagrammatically showing the movement of the wiper blade in the cleaning operation.

FIGS. 8A to 8C diagrammatically show the movement of the wiper blades in performing the cleaning operation. In performing the cleaning operation, the wiper holder 10 is first moved in the direction indicated by the arrow as shown in FIG. 8A, before the recording head 1 is caused to stand by in a position apart from the home position, or before the recording head 1 is moved to the home position. Then, the wiper blades are brought into contact with the supplying device 12 to make the head liquid to be transferred.

Subsequently, the wiper holder 10 is returned to the position shown in FIG. 6, and the recording head is set to the home position, and thereafter the wiper holder 10 is once more moved in the direction indicated by the arrow as shown in FIG. 8B. In this moving process, to begin with, the relatively long wiper blade 9A precedingly slidingly contacts the ejection face 11. At this time, the head liquid 16 which has been transferred to the wiper blade 9A is applied to the ejection face 11, and mixed and stirred with the ink residue and the like which have been adhered thereto. Then, the wiper holder 10 is continuously moved as shown in FIG. 8C, and thereby the mixture of the head liquid and the ink residue is scraped by the following wiper blade 9B.

Figure 9:
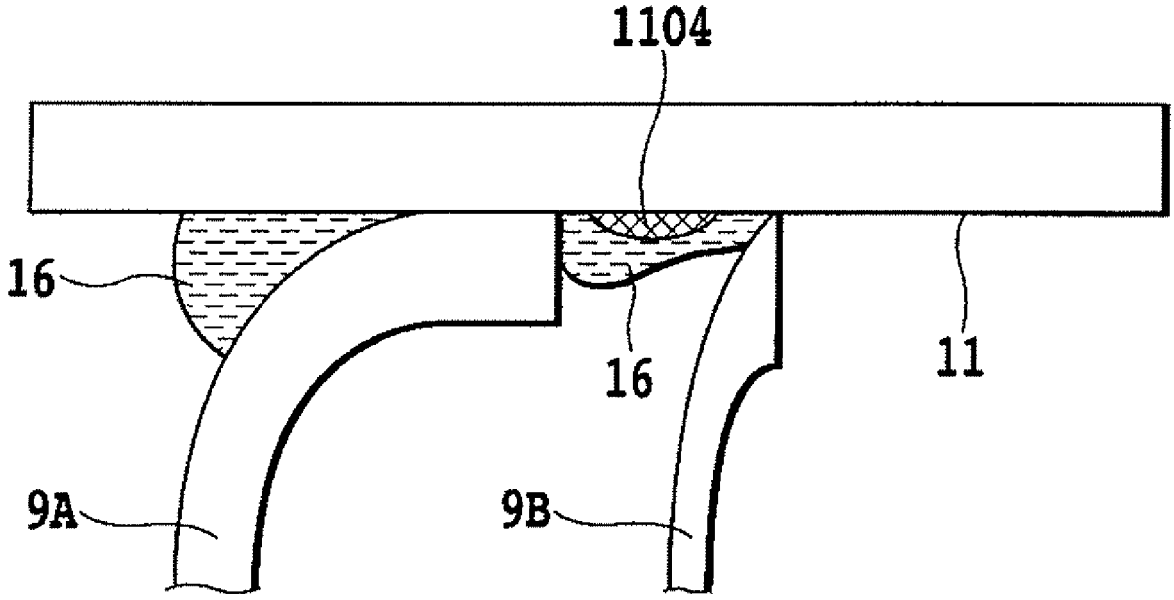
FIG. 9 is a diagrammatic drawing for explaining in more detail the operation of the cleaning device of the FIG. 6.

FIG. 9 is an explanatory drawing of the application of the head liquid as well as the scraping operation of the mixture of the head liquid and the ink residue.

The wiper blade 9A for transferring the head liquid relatively largely bends so that the abdomen thereof slidingly contacts the ejection face by increasing an invasion amount (the height from the position equivalent to the ejection face to the top end of the wiper blade), and thereby the wiper blade does not have an ability to scrape. This allows the head liquid 16 to pass through the ink residue. At this time, it is intended that, even if the ink residue 1104 is slightly moved on the ejection face, the ink residue 1104 is not removed substantially therefrom.

In the above manner, when the head liquid 16 is applied on the ejection face 11 using the wiper blade 9A, and when the head liquid 16 is mixed and stirred with the ink residue and the like adhered to the ejection face 11, the abdomen is preferably slidingly contacted thereto. As such wiping conditions, the wiping blade 9A is configured so as to slidingly pass through the ink residue together with the head liquid, and thereby it is possible to uniformly apply the head liquid to the ink residue, and the ink residue tends to be dissolved in the head liquid. In other words, the sliding contact is performed by the abdomen of the wiper blade 9A, and thereby the head liquid passes between the wiper blade 9A and the ejection face 11. At this time, the ink residue is rubbed with the head liquid, and thereby the stirring of the ink residue and the liquid for head is performed. This stirring accelerates the mixing, resulting in the incorporation of the ink residue into the head liquid.

Here, the relationships of the surface tension of the ejection face 11<the surface tension of the ink<the surface tension of the head liquid is preferable. If the above condition is satisfied, the ink residue having the low surface tension as compared to that of the head liquid is dissolved in the head liquid having the higher surface tension. In other words, the higher surface tension than that in a case of the ink residue alone is created, and the difference in surface tension from the ejection face 11 becomes larger than that in a case of the ink residue alone. Thus, the wetting on the ejection face is reduced, and thereby the ink residue mixed solution easily moves on the ejection face. As a result, the ink residue mixed solution can be easily removed (scraped off) from the ejection face 11 in association with the movement of the following wiper blade 9B.

Such an effect is preferably exhibited in a state where the head liquid is applied in a large amount to a certain extent. To be more specific, a range of 0.1 to 100 times is preferable relative to the amount of the ink residue on the ejection face. An applied amount of 0.05 g to 0.5 g is preferable from the results obtained by using the printer in the example to be described below.

Moreover, as the head liquid, the suitable one can be employed as long as it can be used for dissolving the ink residue effectively. For example, glycerin can be used alone, and the aqueous solution of glycerin can also be used.

The wiper blade 9B is adapted so as to make the ejection face touched by the edge portion of the top end thereof by adjusting the invasion amount to improve the performance of scraping the ink on the ejection face 11, and thereby the wiping residue is hardly left. The touching on the edge is performed in such a manner, and thereby the mixture of the head liquid and the ink residue is smoothly removed unlike the application, mixing and stirring functions of the wiper blade 9A.

The above configuration allows the head liquid to surely be applied on the ejection face 11, and to be mixed and stirred with the ink residue. Thus, the ink residue and the like which are fixedly adhered to the ejection face can easily be removed. Moreover, this effect allows the original surface properties (for example, water-repellent property) of the ejection face to be maintained even after wiping operations are performed many times, and thereby a stable recording performance over a long period of time can be maintained. Furthermore, the effect of the present invention makes it possible to clean the head without the wiping residue being left even when an ink containing a high-molecular polymer is used to disperse a pigment as a color material, and even when an ink containing a dye as a color material is used. These are effective because they increase the stability of the recording performance.

Note that, two kinds of the wiper blades may suitably be changed in terms of material and shape thereof as well as adjusted in the invasion amount as described above in order to make the preceding wiper blade 9A have applying, mixing and stirring functions for the head liquid, and make the following wiper blade 9B have a scraping function.

Moreover, in the present embodiment, the wiping operations are performed in the direction parallel to the nozzle arranging direction (right and left directions of FIG. 4). However, the wiping direction can be suitably determined. The wiping operations may be performed in the direction vertical to the nozzle arranging direction.

(Other Embodiment)

In the above configuration, two wiper blades are used, and the preceding wiper blade 9A has the applying, mixing and stirring functions for the head liquid, and the following wiper blade 9B has a scraping function. However, even one wiper blade can serve both functions. In the present embodiment, the configuration for the above purpose will be described. In the present embodiment, two steps are used for the wiping operation. In other words, the first step is to make the head liquid adhered on one surface of the wiper blade, to apply the head liquid on the ejection face by making the abdomen slidingly contact thereto, and then to mix and stir the head liquid. The second step is to thereafter cause the wiper blade to perform the touching on the edge thereof while moving the wiper blade in the same direction as that in a case where the head liquid has been applied, or the reverse direction thereof, and thereby the mixture of the ink residue and the head liquid is removed.

FIGS. 10A to 10E diagrammatically show the movement of the wiper blade in the cleaning operations according to the present embodiment.

Figure 10A:
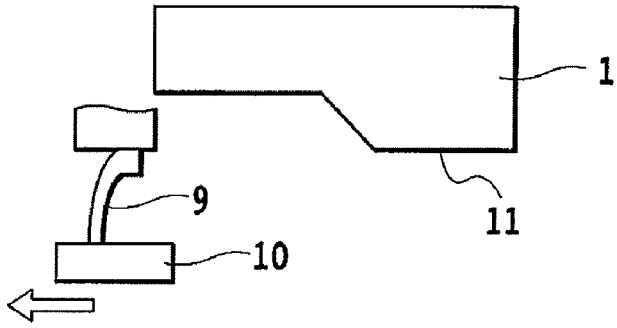
FIG. 10A is an explanatory drawing diagrammatically showing the movement of the wiper blade in the cleaning operation according to a second embodiment of the present invention.

In performing the cleaning operation, the wiper holder 10 is first moved in the direction indicated by the arrow as shown in FIG. 10A, in a state where the recording head 1 is caused to stand by in a position apart from the home position, or before the recording head 1 is moved to the home position. Then, the wiper blade 9 is brought into contact with the supplying device 12 to make the head liquid to be transferred.

Figure 10B:
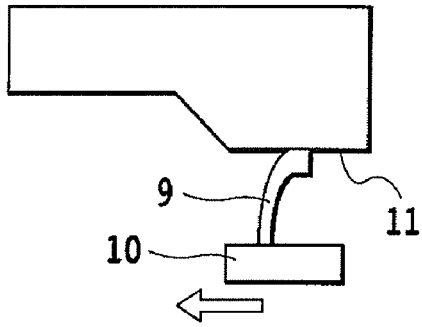
FIG. 10B is an explanatory drawing diagrammatically showing the movement of the wiper blade in the cleaning operation according to the second embodiment of the present invention.
Figure 10C:
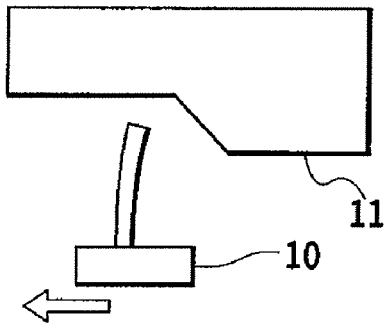
FIG. 10C is an explanatory drawing diagrammatically showing the movement of the wiper blade in the cleaning operation according to the second embodiment of the present invention.

Subsequently, the wiper holder 10 is returned, and the recording head is set to the home position, and thereafter the wiper holder 10 is once more moved in the direction indicated by the arrow as shown in FIG. 10B. In this moving process, the abdomen of the wiper blade 9 precedingly slidingly contacts the ejection face 11. At this time, the head liquid 16 which has been transferred to the wiper blade 9 is applied to the ejection face 11, and mixed and stirred with the ink residue and the like which have been adhered thereto.

Figure 10D:
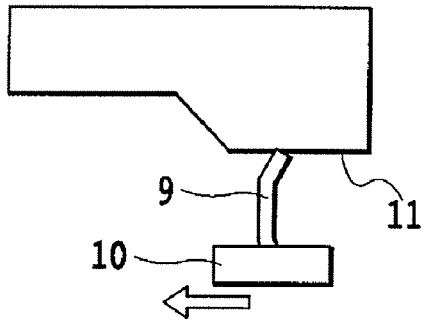
FIG. 10D is an explanatory drawing diagrammatically showing the movement of the wiper blade in the cleaning operation according to the second embodiment of the present invention.
Figure 10E:
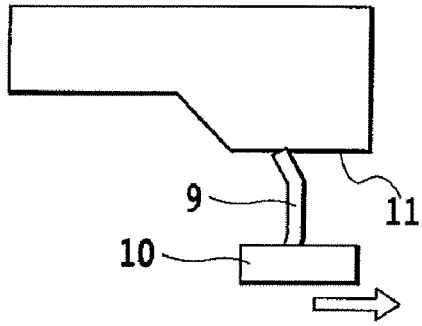
FIG. 10E is an explanatory drawing diagrammatically showing the movement of the wiper blade in the cleaning operation according to the second embodiment of the present invention.

After the above application step (first step) is passed through (FIG. 10C), the wiper blade 9 is returned, and thereby the mixture of the ink residue and the head liquid is removed while the wiper blade 9 is moving in the same direction as that in a case where the head liquid has been applied (FIG. 10D). Alternatively, the mixture of the ink residue and the head liquid is removed (FIG. 10E) while the wiper blade 9 is moving in the reverse direction from the position (FIG. 10C) after the application step. When the moving direction is reversed between during the application of the head liquid and during the scraping thereof, the time for the cleaning operation can be reduced.

In any case, a condition is set such that the wiper blade 9 touches the ejection face 11 at the edge thereof. The following configuration can be employed to switch between the sliding abdomen contact and the edge touch while one wiper blade is used.

For example, if the moving direction is the same between during the application of the head liquid and during the scraping thereof (FIG. 10D), it is only necessary that an invasion amount can be switched such that the invasion amount is large during the application of the head liquid, and small during the scraping. For this purpose, the following means can be used. The means changes the relative height between the recording head and the wiper blade. As this means, a known mechanism can be utilized in which the height of the recording head is changed to set a gap between the ejection face and a surface of the recording medium to be recorded corresponding to the thickness of the recording medium. Alternatively, a mechanism may be used in which the height of the wiper holder 10 holding the wiper blade is changed.

Figure 11A:
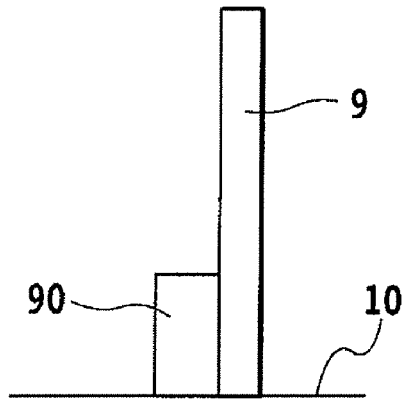
FIG. 11A is an explanatory drawing showing the wiper blade-related configuration and operation which are preferably used to perform the operations of FIGS. 10A to 10C and 10E.
Figure 11B:
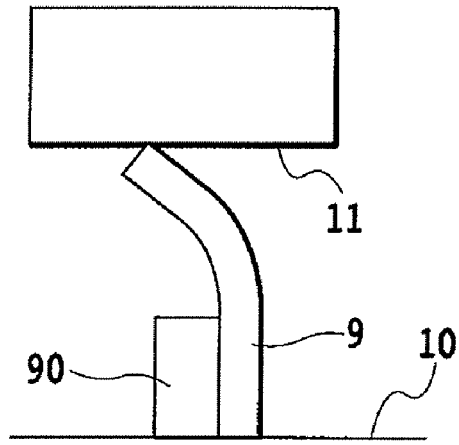
FIG. 11B is an explanatory drawing showing the wiper blade-related configuration and operation which are preferably used to perform the operations of FIGS. 10A to 10C and 10E.
Figure 11C:
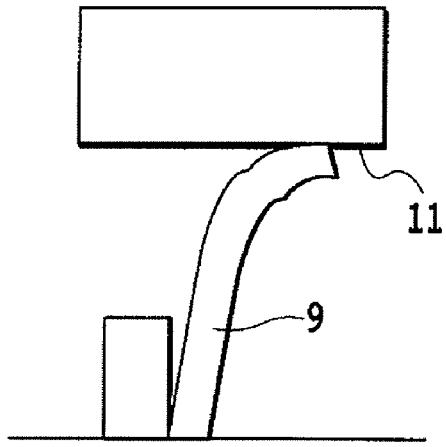
FIG. 11C is an explanatory drawing showing the wiper blade-related configuration and operation which are preferably used to perform the operations of FIGS. 10A to 10C and 10E.

Even when the moving direction is reversed between during the application of the head liquid and during the scraping thereof (FIG. 10E), such a mechanism for changing the invasion amount can be used. A member 90 which restricts the deformation can also be mounted on one side of the wiper blade 9 which is cantilevered. In other words, the edge touch and the sliding abdomen contact can be switched between each other by changing the length of the free length according to the wiping direction as shown in FIGS. 11B and 11C.

The effects of the present invention will be verified below by citing more specific example and comparative example.

EXAMPLE

Surface Tension

Firstly, here, explained is the surface tension described in the present specification.

In the measurement of the surface tension of the ejection face (surface tension of a solid), the wetting test standard solution (wetting reagent) described in JIS K6768-1971 on the ejection face using a cotton swab was firstly applied. Subsequently a wetting reagent-repelling degree in the state immediately after the application (the state of "tailing" of the wetting reagent with the movement of the cotton swab at the time of application) was observed. The measurement method judged the wetting reagent to be "repelling" when the wetting reagent formed a round droplet immediately after the application, and to be "wetting" when the droplet immediately after the application was not a perfect circle. The measurement was carried out in order of the wetting reagent with low surface tension. The surface tension of the wetting reagent applied immediately before a wetting reagent which was firstly judged to be "repelling" was designated as the surface tension of the measured object, i.e. the ejection face.

Moreover, a surface tensiometer "CBVP-A3" available from Kyowa Interface Science Co., LTD. was used to measure the surface tensions of the ink and the head liquid.

The surface tensions of the recording head ejection face, the ink and the head liquid which are used in example to be described below are as follows.

Surface tension of the ejection face: Fγs=22 dyn/cm

Surface tension of the ink: Iγs=36 to 40 dyn/cm

Surface tension of the head liquid: Rγs=37 to 66 dyn/cm

Wiping Duration Test

A wiping duration test was carried out by using the following head liquid and ink, and by changing wiping conditions. Here, assuming the environment for the actual use, the operation of cleaning the ejection face was continuously repeated 5000 times using a printer in combination with a recording operation. Thereafter, the change in the surface properties of the ejection face was observed by evaluating the states of recording before and after the test.

Main Body for Evaluation

The main body used for evaluation was made by modifying the recovery system of an inkjet printer "PIXUS850i" available from Canon Inc. as shown in FIG. 4.

Head for Evaluation

The recording head used for evaluation was a recording head having an ejection face made of a water repellent material which was a negative type resist containing fluorine and siloxane molecules. The surface tension of the ejection face thereof was Fγs=22 dyn/cm.

Ink for Evaluation

The ink having the composition shown in Table 1 was attached in the color tank position of the recording head to perform the evaluation. [Table 1]

TABLE 1

| Composition | | Ink i (self-dispersion + polymer) | Ink ii (dye + polymer) | Ink iii (resin dispersion pigment) |
|---|---|---|---|---|
| Solvent | Glycerin | 5% | 5% | 5% |
| | Diethylene glycol | 5% | 5% | 5% |
| Surfactant | Acetylenol EH ··· (Note 1) | 0.2% | 0.2% | 0.2% |
| Color material | CABOJET 300 (solid content) (self dispersion pigment) ··· (Note 2) | 4% | — | — |
| | CI. DBL: 199 (soluble dye) | — | 3% | — |
| | Pigment dispersion liquid 1··· (Note 3) | — | | 50% |
| Polymer | Styrene/acrylic acid copolymer (Molecular weight: 10000, Acid value: 100) | 2% | 1% | — |
| Water | | Remainder | Remainder | Remainder |
| Surface tension | | 38.0 dyn/cm | 36.0 dyn/cm | 40.0 dyn/cm |

(Note 1)
Trade name Acetylenol available from Kawaken Fine Chemicals Co., Ltd.
(Note 2)
Self-dispersion pigment available from CABOT Corporation
(Note 3)
A pigment dispersion liquid 1 prepared by the following method was used.

10 parts of carbon black having a specific surface area of 210 $m^2/g$ and a DBP oil absorption amount of 74 ml/100 g, 20 parts of 10% sodium hydroxide-neutralized aqueous solution of styrene-acrylic acid copolymer having an acid value of 200 and a weight-average molecular weight of 10000, and further 70 parts of ion-exchanged water were mixed. After the mixture was then dispersed for 1 hour using a sand grinder, rough and large particles were removed by means of a centrifugal separation process. Subsequently, the mixture was subjected to pressure filtration using a micro filter having a pore size of 3.0 μm (available from FUJIFILM Corporation) to obtain a pigment dispersion liquid 1 containing a resin dispersion type pigment. The obtained pigment dispersion liquid 1 had the values of physical properties of a solid content of 10%, a pH of 10.0 and an average particle diameter of 120 nm.

Head Liquid

The head liquids shown in Table 2 were used. [Table 2]

TABLE 2

| Composition | Head liquid A | Head liquid B |
|---|---|---|
| Glycerin | 80% | 80% |
| Water | 20% | 19.9% |
| Acetylenol EH (above described Note 1) | 0% | 0.1% |
| Surface tension | 66 dyn/cm | 37 dyn/cm |

Wiping Conditions

Wiping conditions (1): The following two wiper blades were used as shown in FIG. 7 to FIG. 9.

First wiper blade (corresponding to the wiper blade 9A, the abdominal part of which slidingly contacts the ejection face)

Material: Urethane, Hardness: 75°, Thickness: 0.5 mm, Width: 9 mm

Free length: 6 mm, Invasion amount: 1.75 mm

Second wiper blade (corresponding to the wiper blade 9B, the edge of which slidingly contacts the ejection face)

Material: Urethane, Hardness: 75°, Thickness: 0.5 mm, Width: 9 mm

Free length: 5 mm, Invasion amount: 0.6 mm (2) Wiping conditions (2): The following one wiper blade was used as shown in FIG. 10A to FIG. 10D.

Material: HNBR, Hardness: 75°, Thickness: 0.5 mm, Width: 9 mm

Free length: 5 mm,

Invasion amount of the first step (sliding abdomen contact): 1.2 mm

Invasion amount of the second step (edge touch): 0.6 mm (3) Wiping conditions (3): The configuration of FIG. 1A to FIG. 11C was applied, and the following one wiper blade was used as shown in FIG. 10A to FIG. 10C and FIG. 10D.

Material: Urethane, Hardness: 75°, Thickness: 0.5 mm, Width: 9 mm

Free length of the first step (sliding abdomen contact): 7 mm, Invasion amount: 1.2 mm Free length of the second step (edge touch): 5 mm, Invasion amount: 1.2 mm Evaluation Results Evaluation was performed by observing the changes in the recording state before and after the duration test in a temperature condition of 25° C. in 18 kinds of combinations among the inks for evaluation (three kinds), the head liquid (two kinds), and the wiping conditions (three kinds). At this time, the nozzle check pattern built in the main body of the printer was recorded on a high quality only paper to observe the misalignment (deviation) of the dot formation position. Note that, the evaluation was performed using the following three ratings.

O: A favorable printing is obtained without deviation in the nozzle check pattern (there is no difference from the printing quality obtained when a genuine ink is used in the main body of an unmodified printer).

Δ: Deviations are occurred in apart of the nozzle check pattern.

x: Deviations are occurred in the entire area of the nozzle check pattern.

From the results, even after the wiping operations were continuously performed 5000 times in all of 18 kinds of combinations of the example, a printing performance was maintained at a problem-free level of the actual use as in the initial phase in all the combinations after the wiper operation was continuously repeated 5000 times in the above combinations in the example. In other words, substantial image deterioration such as non-ejection and deviations resulted from the receiving of a large number of pigment particles adhered on the ejection face or the deterioration of water-repellent property was not observed.

As described above, the cleaning of the ejection face of the head becomes possible even when a pigment-containing ink is used, by using the configuration shown in the embodiments or example of the present invention. Therefore, a wiping residue which has an adverse effect on an ink ejection operation is not left. As a result, it is possible to suppress the deterioration of the ejection face such as a scuff on the ejection face due to the adhesion of a polymer on the ejection face 11, and the flocculated matter of a pigment generated in association with repeated wiping operations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A device for cleaning an inkjet head, the inkjet head being provided with ejection outlets through which an ink is ejected and being moveable into and apart from its home position, comprising:

a first wiper moving in a direction intersecting with a moving direction of the inkjet head for slidingly contacting a surface of the inkjet head;

a second wiper moving in a direction intersecting with the moving direction of the inkjet head for slidingly contacting the surface of the inkjet head; and a container for accommodating an ink residue dissolving liquid which is different from the ink, wherein the ink residue dissolving liquid is transferred to the first wiper before the first and second wipers slidingly contact the surface of the inkjet head during a wiping process by bringing the first and second wipers into contact with the container, and wherein the first wiper is located ahead of the second wiper in a moving direction of the wiping process and is adapted to slidingly contact the surface of the inkjet head at a side portion of the first wiper, so that the ink residue dissolving liquid, while being transferred to the surface of the inkjet head only by the first wiper, is mixed with an ink residue on the surface, and wherein the second wiper is adapted to slidingly contact the surface of the inkjet head at an edge portion of the second wiper after the first wiper so that a mixture obtained by mixing is scraped from the surface of the inkjet head.

2. A device according to claim 1, wherein the first and second wipers are constructed as individual members and sequentially slidingly contact the surface of the inkjet head in the process of wiping the inkjet head in the same direction.

3. A device according to claim 1, wherein the inkjet head, the ink, and the ink residue dissolving liquid are such that a surface tension of the inkjet head<a surface tension of the ink<a surface tension of the head liquid.

4. A device according to claim 1, wherein the ink residue dissolving liquid contains glycerin.

5. An inkjet recording apparatus, comprising a device for cleaning an inkjet head as claimed in claim 1.

* * * * *